US007967287B2

(12) United States Patent
Hamasaki et al.

(10) Patent No.: US 7,967,287 B2
(45) Date of Patent: Jun. 28, 2011

(54) SHEET FEEDING APPARATUS AND IMAGE FORMING APPARATUS

(75) Inventors: Ryuji Hamasaki, Yokohama (JP); Eiji Wakiyama, Suntou-gun (JP)

(73) Assignee: Canon Kabushiki Kaisha, Tokyo (JP)

( * ) Notice: Subject to any disclaimer, the term of this patent is extended or adjusted under 35 U.S.C. 154(b) by 2 days.

(21) Appl. No.: 12/511,508

(22) Filed: Jul. 29, 2009

(65) Prior Publication Data

US 2010/0025923 A1 Feb. 4, 2010

(30) Foreign Application Priority Data

Jul. 31, 2008 (JP) ..... 2008-198732

(51) Int. Cl.
*B65H 1/00* (2006.01)

(52) U.S. Cl. ..... 271/171; 271/9.11; 271/223

(58) Field of Classification Search ..... 271/9.11, 271/171, 207, 220, 223
See application file for complete search history.

(56) References Cited

U.S. PATENT DOCUMENTS

| | | | | |
|---|---|---|---|---|
| 4,657,239 | A * | 4/1987 | Ikesue et al. | 271/227 |
| 5,116,034 | A * | 5/1992 | Trask et al. | 271/2 |
| 5,823,522 | A * | 10/1998 | Fujiwara et al. | 271/4.08 |
| 5,927,702 | A * | 7/1999 | Ishii et al. | 271/9.09 |
| 6,543,758 | B2 | 4/2003 | Imura et al. | 271/9.12 |
| 7,547,011 | B2 * | 6/2009 | Kurata et al. | 271/9.11 |
| 7,562,867 | B2 * | 7/2009 | Asada et al. | 271/9.09 |
| 7,618,035 | B2 * | 11/2009 | Koga et al. | 271/9.11 |
| 7,631,861 | B2 * | 12/2009 | Takahashi | 271/9.09 |
| 2007/0075477 | A1 * | 4/2007 | Shiohara | 271/9.08 |
| 2009/0066009 | A1 | 3/2009 | Matsushima et al. | 271/18 |

FOREIGN PATENT DOCUMENTS

| | | |
|---|---|---|
| JP | 11-59925 | 3/1999 |
| JP | 11-217123 | 8/1999 |
| JP | 2005-263450 | 9/2005 |

* cited by examiner

*Primary Examiner* — Kaitlin S Joerger
*Assistant Examiner* — Prasad V Gokhale
(74) *Attorney, Agent, or Firm* — Fitzpatrick, Cella, Harper & Scinto

(57) ABSTRACT

The present invention provides a sheet feeding apparatus and an image forming apparatus, in which a sheet can stably be fed with a simple configuration without decreasing strength of an intermediate plate.

A fixed member 19 and a movable member 13, which regulate positions in a width direction of the sheet that is stacked on the dedicated cassette 30 detachably attached to an intermediate plate 6, are provided while facing each other. The fixed member 19 and the movable member 13 moved to a position that regulates the sheet are regulated by side regulating members 7 and 8. The side regulating members 7 and 8 that are movable in the width direction regulate the positions in the width direction of the sheet stacked on the intermediate plate 6.

6 Claims, 13 Drawing Sheets

SHEET FEEDING APPARATUS AND IMAGE FORMING APPARATUS

BACKGROUND OF THE INVENTION

1. Field of the Invention

The present invention relates to a sheet feeding apparatus and an image forming apparatus, particularly to a sheet feeding apparatus in which a second sheet stacking portion is detachably attached to a first sheet stacking portion and an image forming apparatus containing such a sheet feeding apparatus.

2. Description of the Related Art

Recently, an image forming apparatus such as a copying machine, a printer, and a facsimile, in which the sheet is fed from the sheet feeding apparatus to the image forming portion to form an image is widely spread. Usually, in the sheet feeding apparatus, a sheet cassette that is of a sheet storage portion is detachably attached to an apparatus main body, and the sheet stored in the sheet cassette is automatically fed to the image forming portion.

In some of the sheet cassettes used in sheet feeding apparatus, an intermediate plate on which the sheets are stacked to press the sheet against a sheet feeding roller is provided while being able to be lifted and lowered. In the sheet cassette in which the intermediate plate is provided, a trailing end regulating member that regulates a position of a trailing end in a feeding direction of the sheet stacked and stored on the intermediate plate (hereinafter referred to as trailing end) is provided so as to enable storage of sheets having different sizes. A side end regulating member is also provided to regulate a side end position in a direction (hereinafter referred to as width direction) orthogonal to the sheet feeding direction.

In the sheet cassette, the sheet trailing end is regulated by the trailing end regulating member while the sheet side end is regulated by the side end regulating member, whereby the sheet leading end is always regulated at a predetermined position. Therefore, the sheet can stably be fed irrespective of the sheet size when the sheet cassette is stored in the apparatus main body.

Recently, the demand to form an image in a small-size sheet that is of an irregular size sheet such as a 4-by-6-inch-size sheet and a postcard-size sheet in addition to a special sheet has increased for image forming apparatus such as the laser beam printer.

However, for example, when the small-size sheet is set in the sheet cassette, the small-size sheet is located outside a range where the side end regulating member and the trailing end regulating member are moved. Therefore, when the small-size sheet is set in the sheet cassette, the position of the sheet cannot be regulated by the side end regulating member and the trailing end regulating member.

In order to regulate the small-size sheet whose position cannot be regulated by the regulating member, for example, Japanese Patent Application Laid-Open No. 2005-263450 discloses a technique in which the side end regulating member can be moved to a position that regulates the small-size sheet. The intermediate plate is notched in the width direction in order to enable the side end regulating member to be moved in the width direction.

Japanese Patent Application Laid-Open No. 11-217123 discloses a technique in which an attachment is attached to the side end regulating member. Japanese Patent Application Laid-Open No. 11-059925 discloses a technique in which a dedicated cassette that is of a small-size-sheet regulating member is detachably attached to the sheet cassette.

However, in the conventional sheet feeding apparatus and image forming apparatus, when the intermediate plate is notched such that the side end regulating member can be moved in the width direction, it is necessary that the intermediate plate is largely notched in order to enable the side end regulating member to be moved to the position that regulates the small-size sheet. When the attachment is attached to the side end regulating member, it is necessary that the attachment is moved to the side end position of the small-size sheet. Therefore, it is necessary to largely notch the intermediate plate. A strength of the intermediate plate is decreased when the intermediate plate is largely notched.

On the other hand, when the dedicated cassette is detachably attached to the sheet cassette, it is not necessary to largely notch the intermediate plate. However, the sheet cannot stably be fed because the side end regulating member that regulates the sheet position in the width direction is not provided in the dedicated cassette. Even if the side end regulating member is provided, a mechanism for fixing the side end regulating member moved to a side end regulating position is required to stably feed the sheet. When the mechanism is provided, a configuration of the dedicated cassette becomes complicated and cost is increased.

The present invention provides a sheet feeding apparatus and an image forming apparatus, in which a sheet can stably be fed with a simple configuration without decreasing strength of an intermediate plate.

SUMMARY OF THE INVENTION

A sheet feeding apparatus according to an aspect of the invention including a sheet stacking portion on which a sheet is stacked; a pair of first regulating portions that is provided while being movable in a width direction of the sheet in order to regulate a position in the width direction of the sheet stacked on the sheet stacking portion; a sheet stacking unit that is attached to the sheet stacking portion; and a pair of second regulating portions that regulates the position in the width direction of the sheet stacked on the sheet stacking unit, wherein at least one of the second regulating portions is movable in the width direction, and the pair of second regulating portions are regulated by the pair of first regulating portions, respectively.

Accordingly, the position of the second regulating member of the second sheet stacking portion is regulated by the first regulating member that regulates the position of the sheet stacked on the first sheet stacking portion, so that the sheet can stably be fed with the simple configuration without decreasing the strength of the intermediate plate.

Further features of the present invention will become apparent from the following description of exemplary embodiments with reference to the attached drawings.

DESCRIPTION OF THE EMBODIMENTS

An exemplary embodiment of the invention will be described in detail with reference to the drawings.

Figure 1:
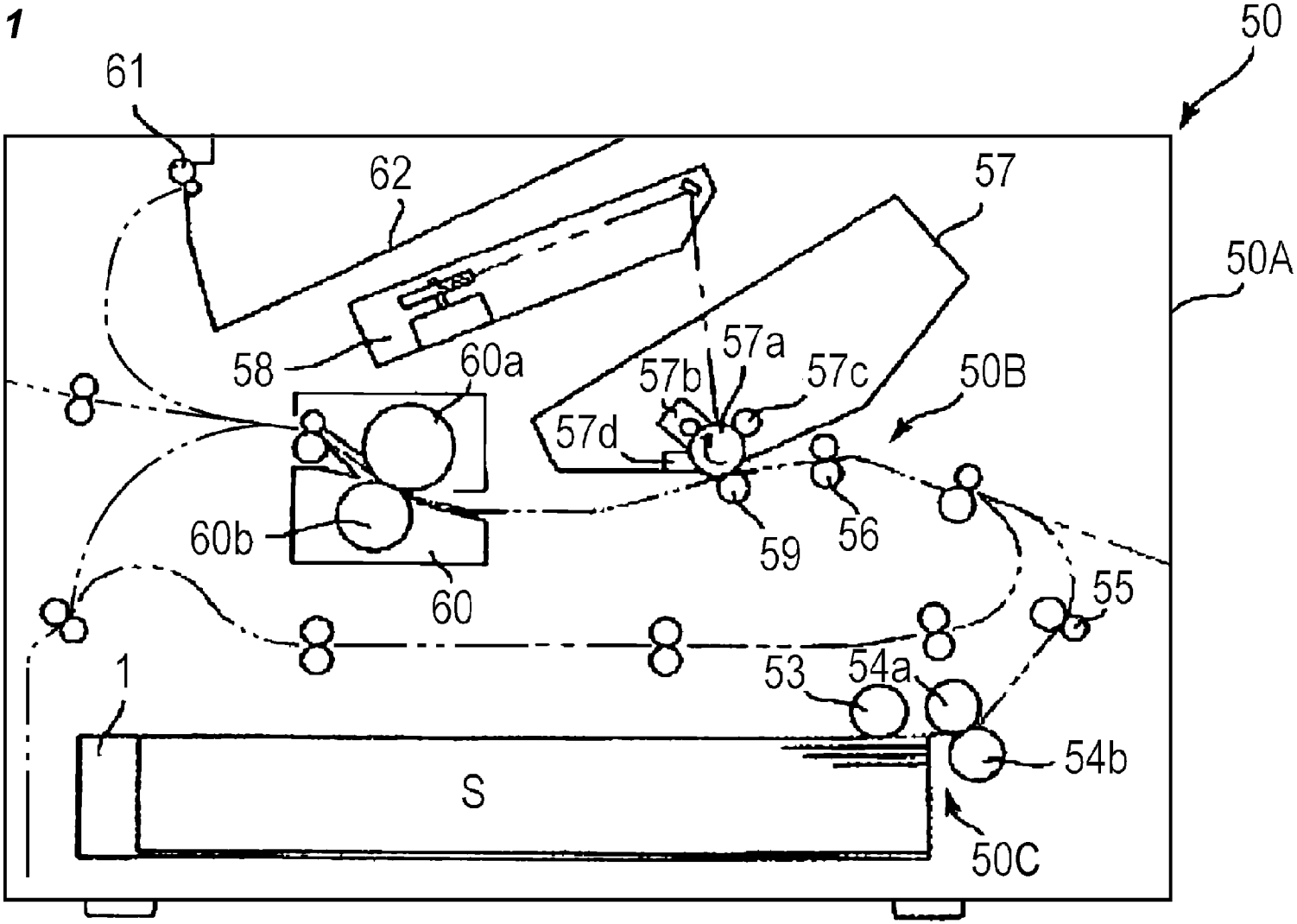
FIG. 1 illustrates an entire configuration of a Laser Beam Printer (LBP) that is of an example of an image forming apparatus including a sheet conveying apparatus according to an embodiment of the invention.

FIG. 1 illustrates an entire configuration of a Laser Beam Printer (LBP) that is of an example of an image forming apparatus including a sheet conveying apparatus according to an embodiment of the invention.

Referring to FIG. 1, in a laser beam printer 50, a laser beam printer main body (hereinafter referred to as printer main body) 50A includes an image forming portion 50B, and a sheet feeding apparatus 50C is provided in a lower part of the printer main body 50A. The sheet feeding apparatus 50C feeds a sheet S, such as a recording sheet, which is stacked and stored in a sheet cassette 1 to the image forming portion 50B.

The image forming portion 50B includes a process cartridge 57, and the process cartridge 57 includes a photosensitive drum 57*a*, a charger 57*b*, a development sleeve 57*c*, and a cleaner 57*d*. The image forming portion 50B also includes a laser scanner 58 that is of exposure unit for exposing a surface of the photosensitive drum 57*a* to form an electrostatic latent image on the photosensitive drum 57*a*.

The printer main body 50A also includes a transfer roller 59 and a fixing portion 60. The transfer roller 59 abuts on the photosensitive drum 57*a*, and the transfer roller 59 and the photosensitive drum 57*a* constitute a transfer portion. The fixing portion 60 fixes a toner image, transferred by the transfer portion, onto the sheet S.

The sheet feeding apparatus 50C includes the sheet cassette 1 and a pickup roller 53. The sheet cassette 1 is of a sheet storage portion that is detachably attached to the printer main body 50A. The pickup roller 53 delivers the sheets S stacked on the sheet cassette 1 from the uppermost side. The sheet feeding apparatus 50C also includes a pair of retard rollers 54*a* and 54*b* that separates and conveys the sheet S delivered by the pickup roller 53.

Next, an image forming operation in the laser beam printer 50 configured in this manner will be described.

When the image forming operation is started, the photosensitive drum 57*a* is rotated in an arrow direction, the surface of the photosensitive drum 57*a* is charged by the charger 57*b*, and a laser beam is emitted to the photosensitive drum 57*a* from the laser scanner 58 based on the image information. Therefore, electrostatic latent image is formed on the photosensitive drum.

Then, toner that is properly charged according to the rotation of the development sleeve 57*c* is supplied onto the photosensitive drum 57*a* to adhere to the electrostatic latent image, whereby the electrostatic latent image is developed and visualized as a toner image.

On the other hand, in parallel with the toner image forming operation, the pickup roller 53 is rotated to deliver the uppermost sheet S on the sheet cassette 1. The pair of retard rollers 54*a* and 54*b* conveys the sheet S delivered from the pickup roller 53, and a pair of registration rollers 56 that is at a stop performs a leading end positioning (skew feeding correction).

Then, in the image forming portion 50B, the pair of registration rollers 56 conveys the sheet S to the transfer portion such that the sheet S is timed to the image formed on the photosensitive drum 57*a*, and the transfer roller 59 transfers the image of the photosensitive drum 57*a* to the sheet S.

Then, the sheet S to which the toner image is transferred is conveyed to a fixing nip. The fixing nip includes a heating roller 60*a* and a pressure roller 60*b*, which are provided in the fixing portion 60. In the fixing nip, the unfixed toner image is fixed to the sheet surface by heating and pressurization. A discharge roller 61 discharges the sheet S, to which the toner image is already fixed, onto a discharge tray 62.

Figure 2:
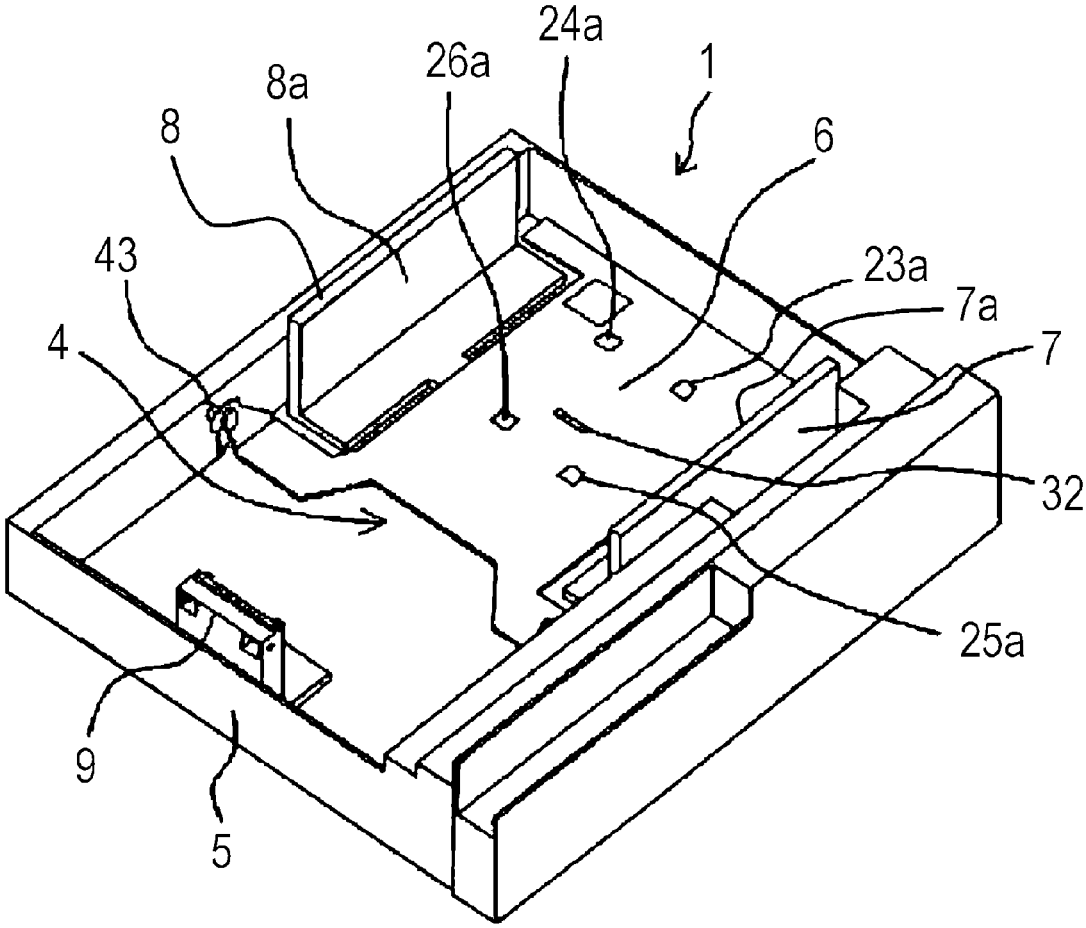
FIG. 2 is a perspective view illustrating a sheet cassette that is detachably attached to a printer main body of the laser beam printer.

As illustrated in FIG. 2, the sheet cassette 1 includes a cassette body 5 and an intermediate plate 6. In the cassette body 5, a sheet storage space 4 is formed to stack and store sheets having various sizes. The intermediate plate 6 is of a first sheet stacking portion that is provided to stack the sheets S while being able to be vertically swung. The intermediate plate 6 can be lifted and lowered about a swing shaft 43 by a swing mechanism (not illustrated). The sheet cassette 1 includes side regulating members 7 and 8 and a trailing end regulating member 9. The side regulating members 7 and 8 are of a pair of width regulating plates, and the pair of width regulating plates is of a first regulating portion that regulates a side end position of the sheet. The trailing end regulating member 9 is of a regulating portion that regulates a trailing end position of the sheet.

Figure 3:
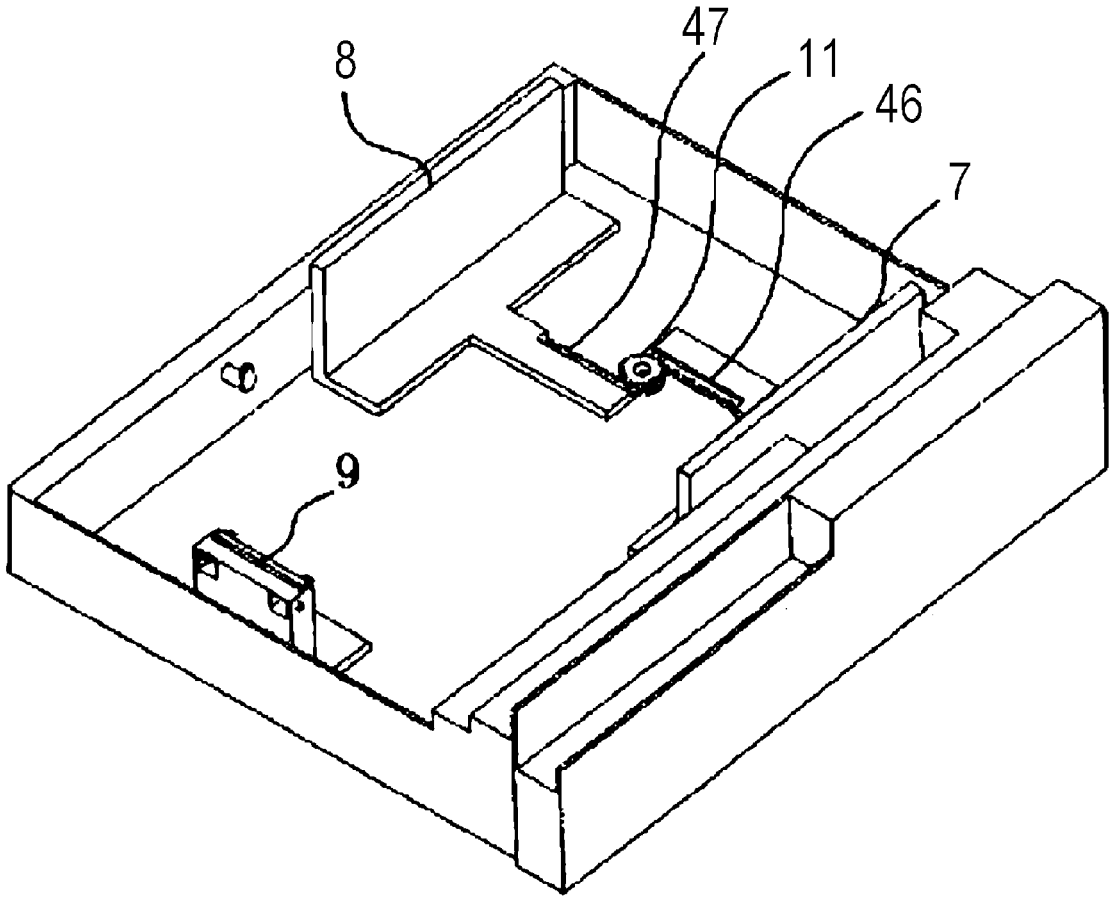
FIG. 3 is a perspective view illustrating a configuration for moving a side regulating plate provided in the sheet cassette.

The side regulating members 7 and 8 and the trailing end regulating member 9 are movable according to the sheet size. As illustrated in FIG. 3, the side regulating members 7 and 8 include racks 46 and 47 that are engaged with a pinion 11, and the side regulating members 7 and 8 are moved in opposite directions to each other by the same amount using the racks 46 and 47 and the pinion 11. The side regulating members 7 and 8 are moved in opposite directions to each other by the same amount, thereby feeding the sheet based on the center of the sheet cassette 1.

Figure 4A:
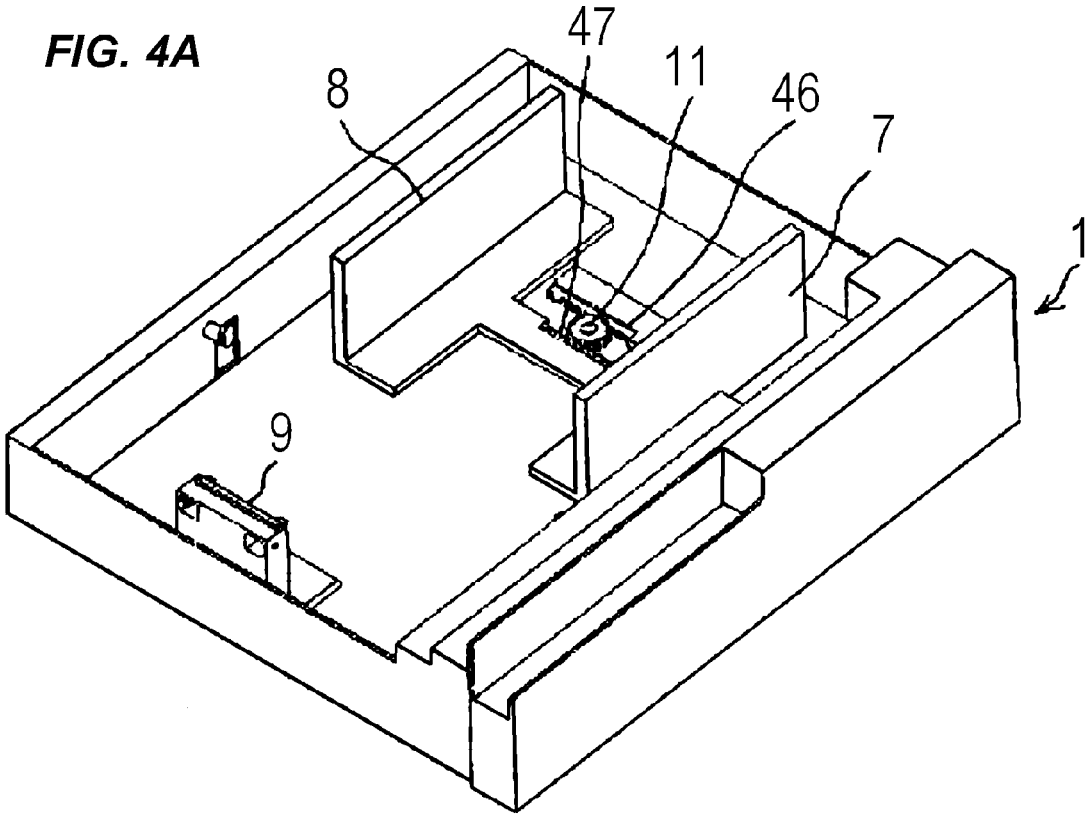
FIGS. 4A and 4B are perspective views illustrating an operation for storing A5-size sheets in the sheet cassette.

FIG. 3 illustrates positions of the side regulating members 7 and 8 and trailing end regulating member 9 when a large-size sheet, for example, an A4-size sheet is stored. When a small-size sheet, for example, an A5-size sheet is stored, each side of the side regulating members 7 and 8 is moved in the direction in which one of the side regulating members 7 and 8 is brought close to the other as illustrated in FIG. 4A. Therefore, the side regulating members 7 and 8 are moved toward the center of the sheet cassette 1.

Figure 4B:
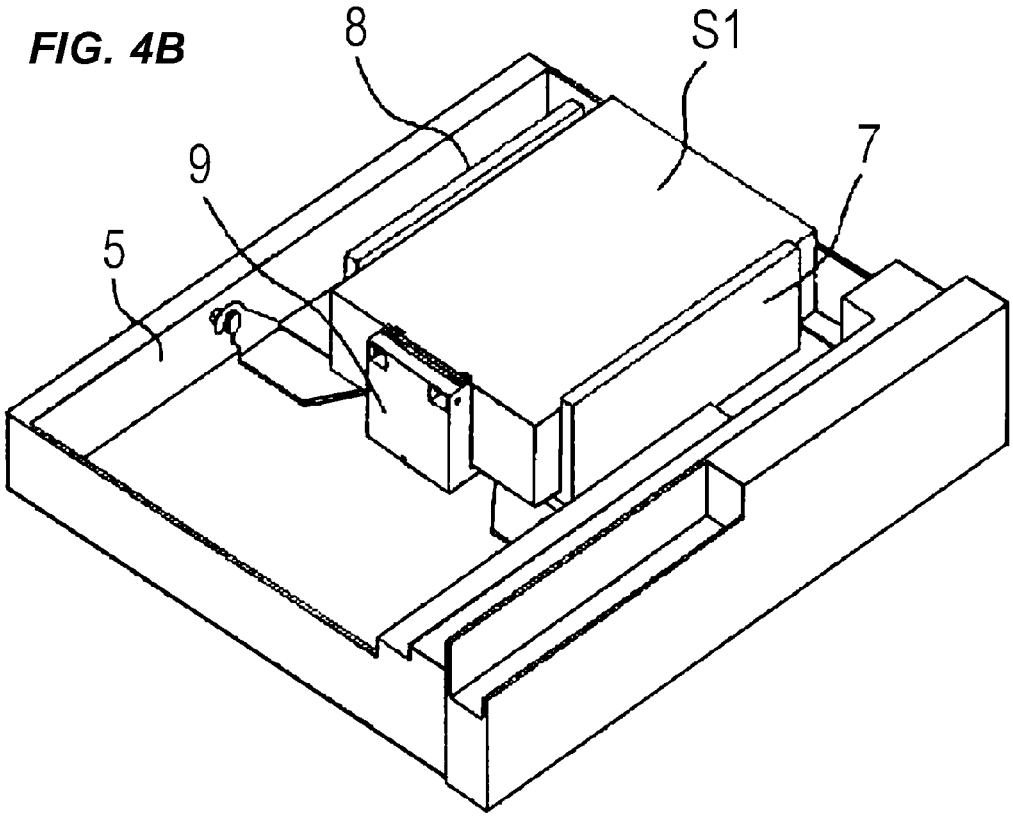

After an A5-size sheet S1 is set between the side regulating members 7 and 8, as illustrated in FIG. 4B, the trailing end regulating member 9 is brought in abutting contact with the trailing end of the A5-size sheet while the side regulating members 7 and 8 are brought in abutting contact with the side end of the sheet, whereby the side end position and trailing end position of the A5-size sheet S1 are positioned to complete the setting of the sheet S1. Therefore, the positioning of the sheet S1 enables the sheet to be stably fed.

Figure 5:
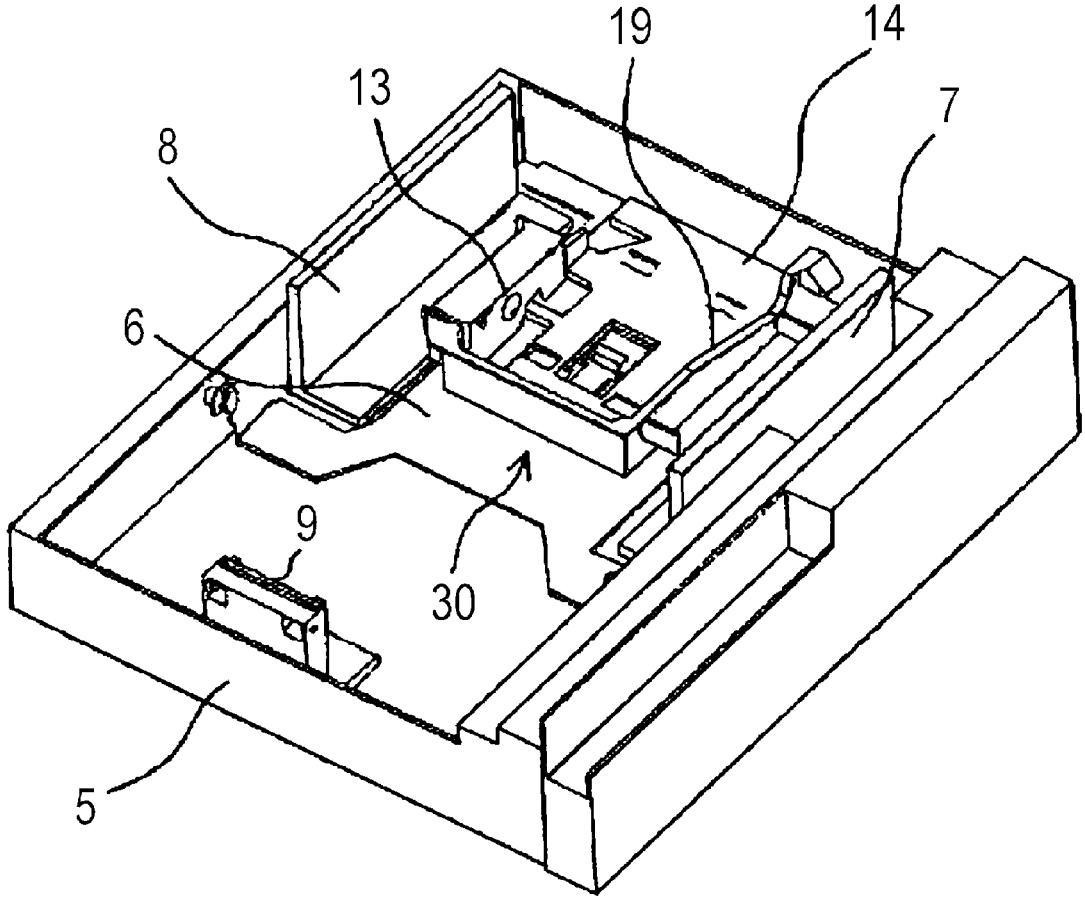
FIG. 5 is a perspective view illustrating a state in which a dedicated cassette is attached to the sheet cassette.

The sheet having the A5 size or more can be stored in the sheet cassette 1. When a user prints a postcard, a cassette 30 that is of an attachment dedicated to the small-size sheet is detachably attached to the intermediate plate 6 as illustrated in FIG. 5. For example, the cassette dedicated to the small-size sheet (hereinafter referred to as dedicated cassette) 30 can deal with the postcard-size, a 4-by-6-inch-size sheet, and a small-size sheet. A special sheet can also be stored in the dedicated cassette 30.

Figure 6A:
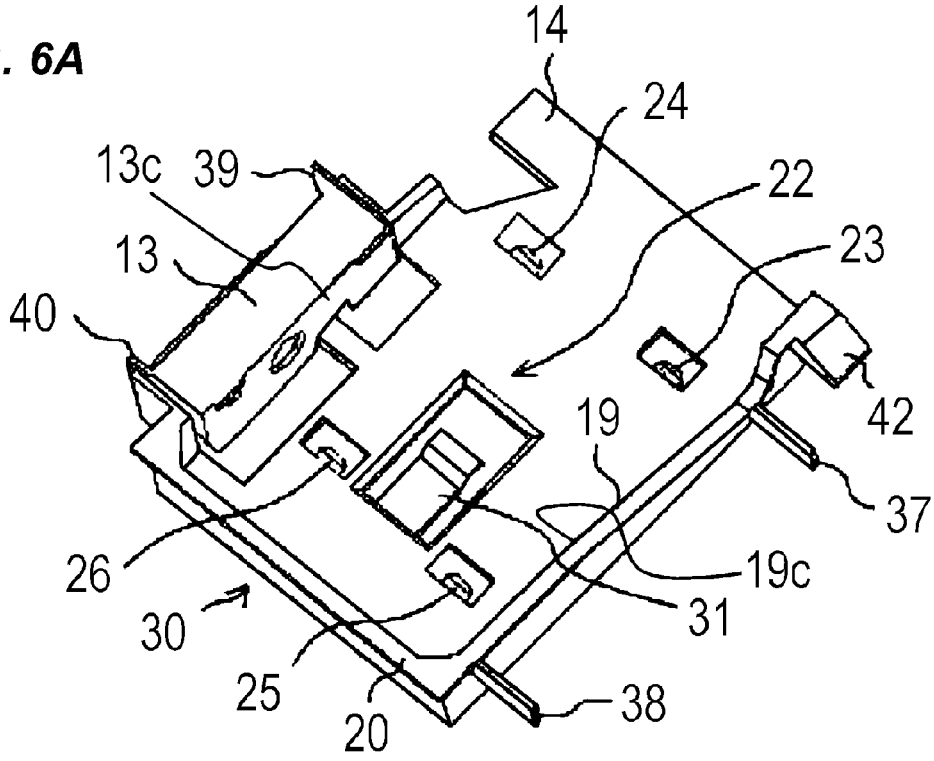
FIGS. 6A and 6B are first views illustrating a configuration of the dedicated cassette.
Figure 6B:
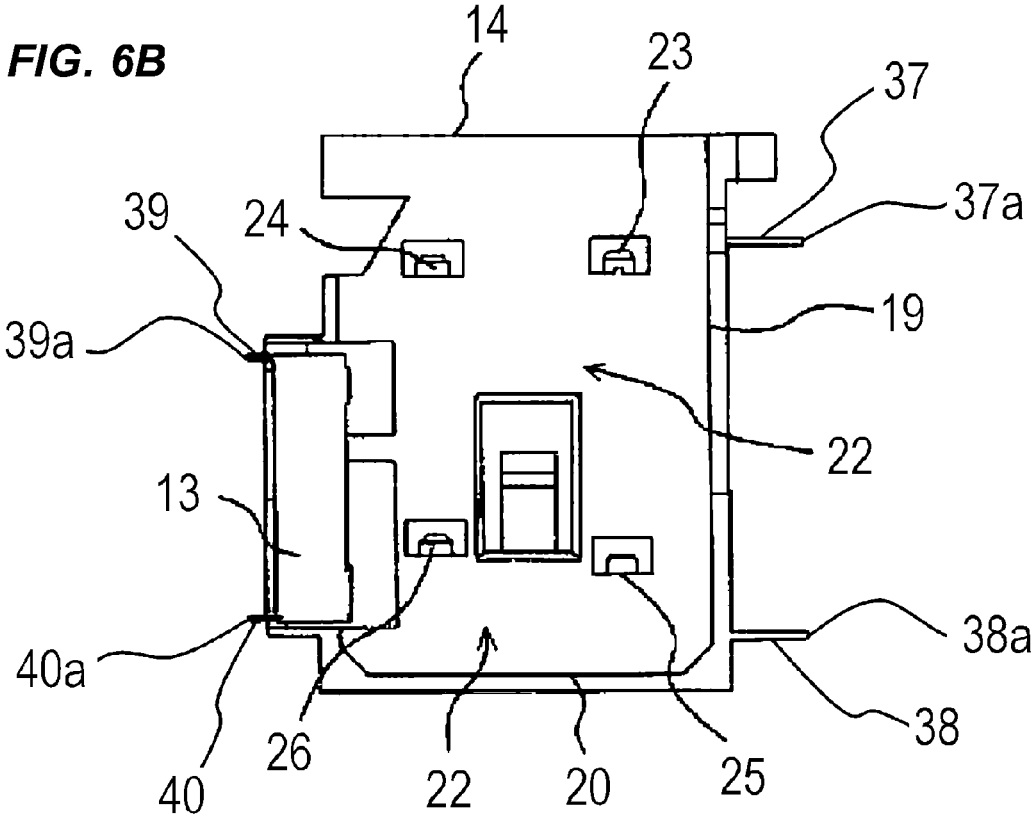

As illustrated in FIGS. 6A and 6B, the dedicated cassette 30 that is of a sheet stacking unit includes a sheet stacking portion 14, a latching projection 31, and four insertion units 23 to 26. The latching projection 31 is projected from a bottom of the sheet stacking portion 14 and extended in an attaching direction. The latching projection 31 and the four insertion units 23 to 26 are inserted from the attaching direction into a latching opening 32 and insertion holes 23*a* to 26*a*, which are made in the intermediate plate 6 as illustrated in FIG. 2, which allows the dedicated cassette 30 to be detachably attached to the intermediate plate 6.

The dedicated cassette 30 includes a fixed member 19, a movable member 13, and rear-side wall 20. The fixed member 19 is vertically provided on one of sides of the sheet stacking portion 14 and extended in the sheet feeding direction. The movable member 13 is movable in the width direction along the sheet stacking portion 14. That is, in the embodiment, the dedicated cassette 30 includes the fixed member 19 and the movable member 13, which are disposed as a second regulating portion while facing each other. The second regulating portion regulates the position in the width direction of the sheet stacked on the dedicated cassette 30. A small-size-sheet storage space 22 is formed by a bottom of the sheet stacking portion 14, the fixed member 19, the rear-side wall 20, and the movable member 13.

Figure 7:
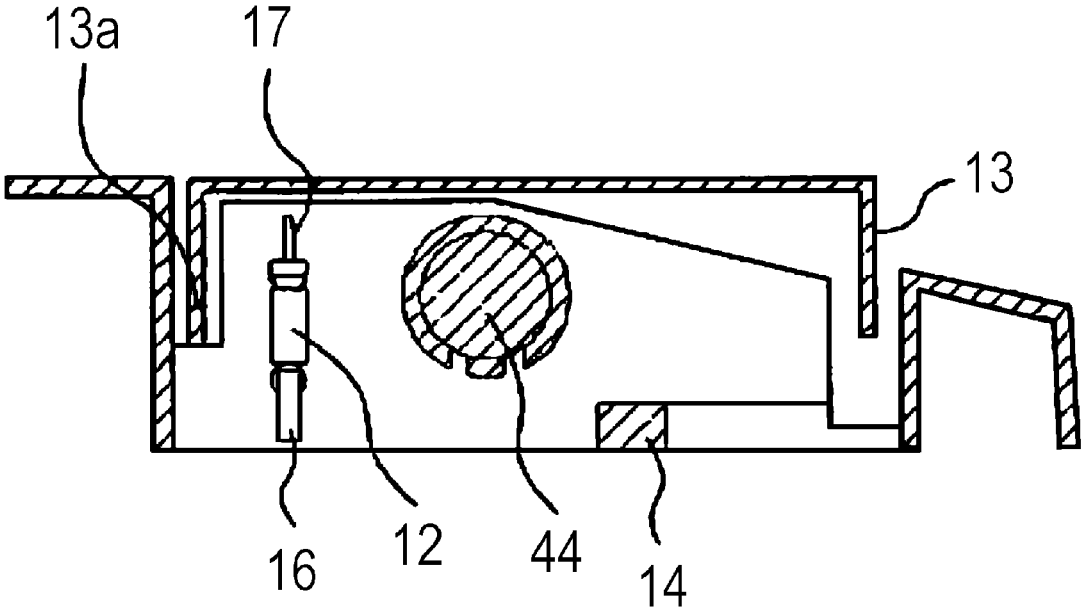
FIG. 7 is a second view illustrating the configuration of the dedicated cassette.

As illustrated in FIG. 7, the movable member 13 is retained while being able to swing with respect to the sheet stacking portion 14 by a shaft 44, and the shaft 44 is supported in a frame (not illustrated) provided on the movable member side of the sheet stacking portion 14 while the shaft 44 and the movable member 13 are slidable in the width direction.

A hook portion 17 is provided in the movable member 13, and one of ends of a spring 12 that is of a biasing member is latched in the hook portion 17. The other end of the spring 12 is latched in a hook portion 16 provided in the sheet stacking portion 14. In the movable member 13 in which the spring 12 is latched, an end portion 13*a* is brought in abutting contact with a receiving portion vertically provided in the sheet stacking portion 14 while biased by the spring 12, thereby regulating the position of the movable member 13.

Figure 8:
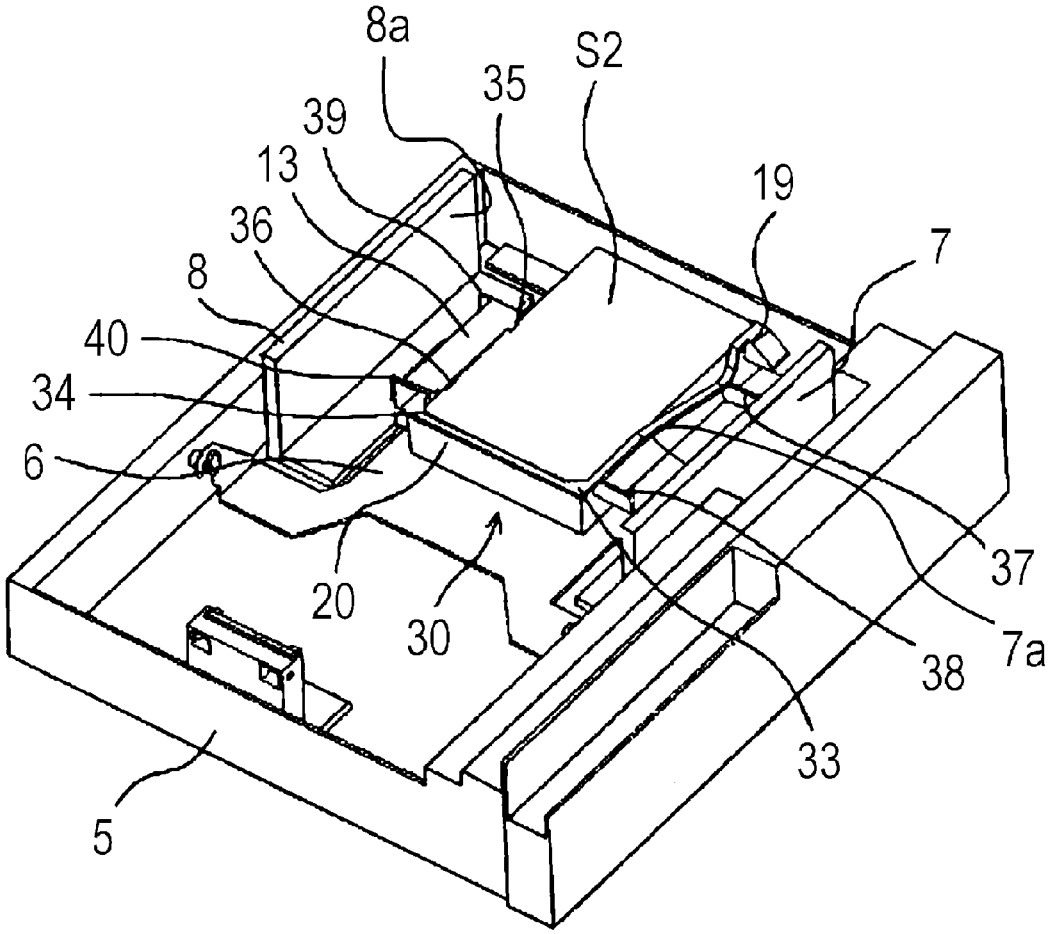
FIG. 8 is a perspective view illustrating a state in which small-size sheets is set in the dedicated cassette.

FIG. 8 illustrates a state in which small-size sheets S2 is set in the dedicated cassette 30. In a small-size sheet S2 set in the dedicated cassette 30, one of the side end positions is regulated by moving the movable member 13 toward the fixed member side. The movable member 13 is moved to press the small-size sheet S2 against the fixed member 19, thereby feeding the small-size sheet S2 based on one side of the fixed member 19.

Figure 9A:
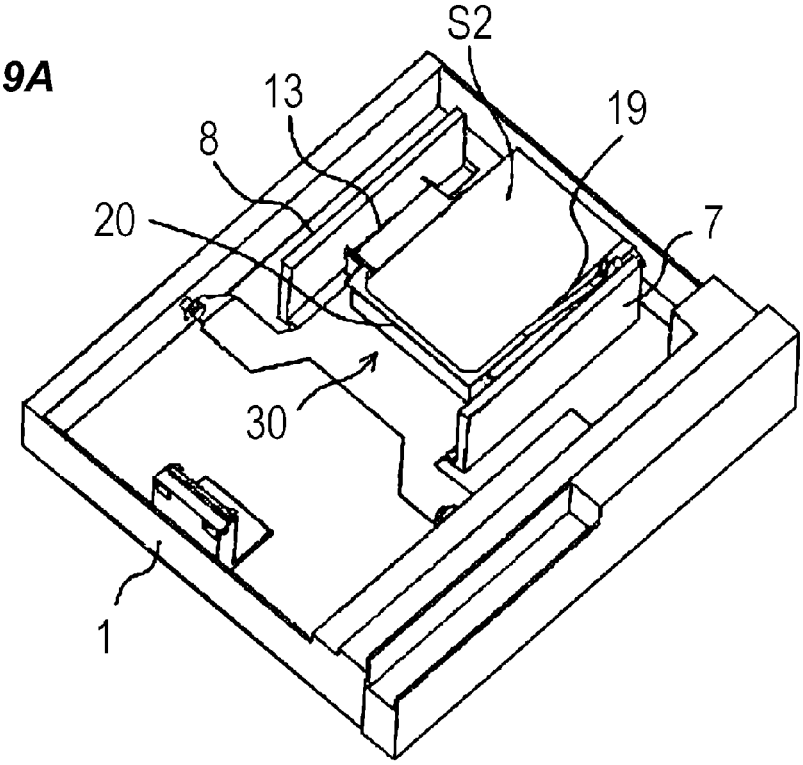
FIGS. 9A and 9B illustrate an operation for regulating side end positions of the small-size sheets stored in the dedicated cassette.
Figure 9B:
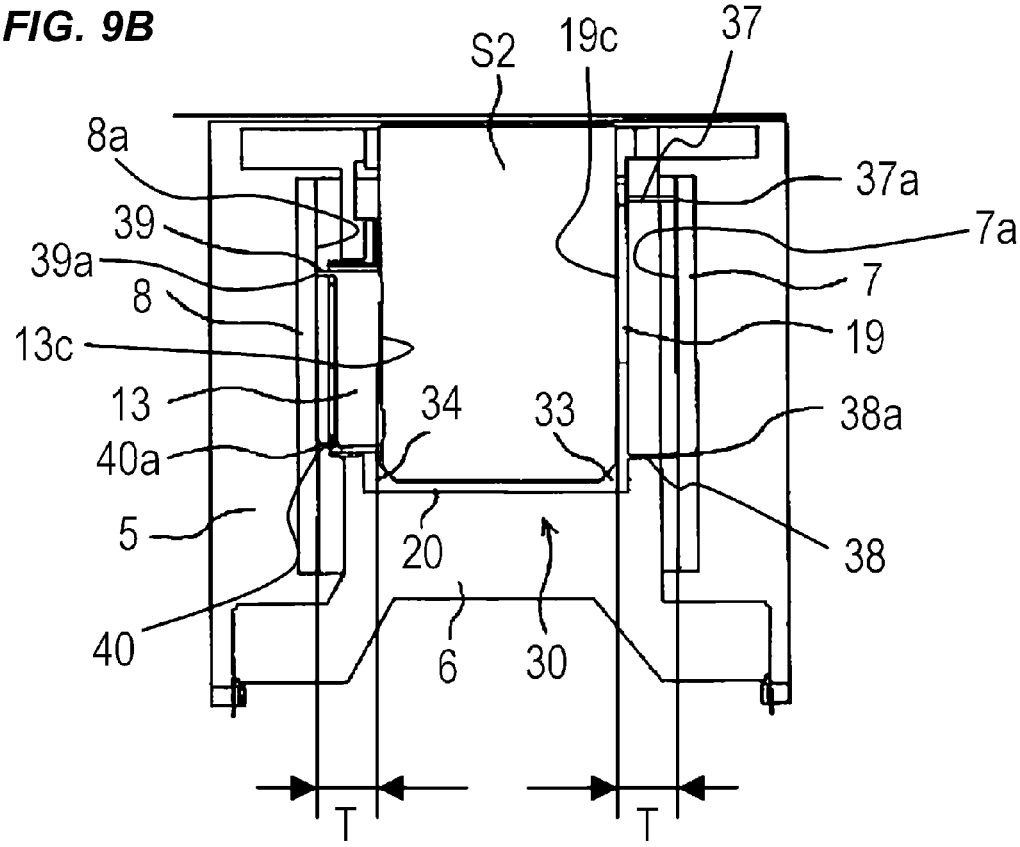

In FIGS. 8, 9A and 9B, movable-member hoods 34 and 35 are provided in the movable member 13, and a hood 33 is provided in the fixed member 19. In feeding the sheet, the provision of the hoods 33 to 35 can prevent the small-size sheet S2 whose side end positions are regulated by the movable member 13 and fixed member 19 from deviating from the dedicated cassette 30. In FIGS. 8, 9A and 9B, fixed member receiving portions 37 and 38 that are of a positioning portion are projected from an outside wall surface of the fixed member 19, and movable member receiving portions 39 and 40 that are of the positioning portion are projected from an outside wall surface of the movable member 13. Abutment surfaces 37*a* and 38*a* and abutment surfaces 39*a* and 40*a* are formed into a flat shape. The abutment surfaces 37*a* and 38*a* abut on a regulating surface 7*a* that regulates the sheet in the side regulating member 7 of the fixed member receiving portions 37 and 38, and the abutment surfaces 39*a* and 40*a* abut on a regulating surface 8*a* that regulates the sheet in the side regulating member 8 of the movable member receiving portions 39 and 40. A distance T from a regulating surface 19*c* that regulates the sheet of the fixed member 19 to the abutment surfaces 37*a* and 38*a* of fixed member receiving portions (the positioning portions) 37 and 38 are set equal to a distance T from a regulating surface 13*c* that regulates the sheet of the movable member 13 to the abutment surfaces 39*a* and 40*a* of the positioning portions 39 and 40.

An operation for regulating the side end position of the small-size sheet S2 stored in the dedicated cassette 30 will be described.

As illustrated in FIG. 8, the movable member 13 is moved to regulate the position of the small-size sheet S2 set in the dedicated cassette 30, and the side regulating members 7 and 8 are moved in the width direction. Therefore, as illustrated in FIG. 9A, the fixed member 19 and the movable member 13 moved to the position that regulates the small-size sheet S2 are sandwiched between the side regulating members 7 and 8 while the fixed member receiving portions 37 and 38 and the movable member receiving portions 39 and 40 are interposed therebetween.

When the fixed member 19 and the movable member 13 are sandwiched between the side regulating members 7 and 8, the movable member 13 that regulates the movement in the width direction of the small-size sheet S2 can be prevented from deviating from the regulating position in feeding the sheet. Therefore, the small-size sheet can stably be fed with the simple configuration without largely notching the intermediate plate 6.

In the embodiment, as described above, the side regulating members 7 and 8 are moved in the opposite directions to each other by the same amount, and the sheet is fed based on the center of the sheet cassette 1 using the side regulating members 7 and 8. The movable member 13 is moved to press the sheet S2 against the fixed member 19, thereby regulating one of the side end positions of the small-size sheet S2. That is, in the embodiment, the movable member 13 and the fixed member 19 are sandwiched between the side regulating members 7 and 8 that feed the sheet based on the center of the sheet cassette 1, thereby feeding the small-size sheet S2 based on one side of the fixed member 19.

Further, in the embodiment, the intermediate plate 6 is provided while being movable in the width direction with respect to the cassette body 5. Therefore, even if the dedicated cassette 30 is fixed to the intermediate plate 6, the dedicated cassette 30 can be moved in the width direction, and the position of the small-size sheet S2 can be changed in the width direction.

When the intermediate plate 6 is moved in the width direction, the small-size sheet S2 that is moved based on one side of the sheet cassette 1 can be fed based on the center of the sheet cassette 1. When the intermediate plate 6 is fixed to the cassette body 5 in the width direction, the same effect can be obtained even if the dedicated cassette 30 is attached while being movable in the width direction with respect to the intermediate plate 6.

Figure 10:
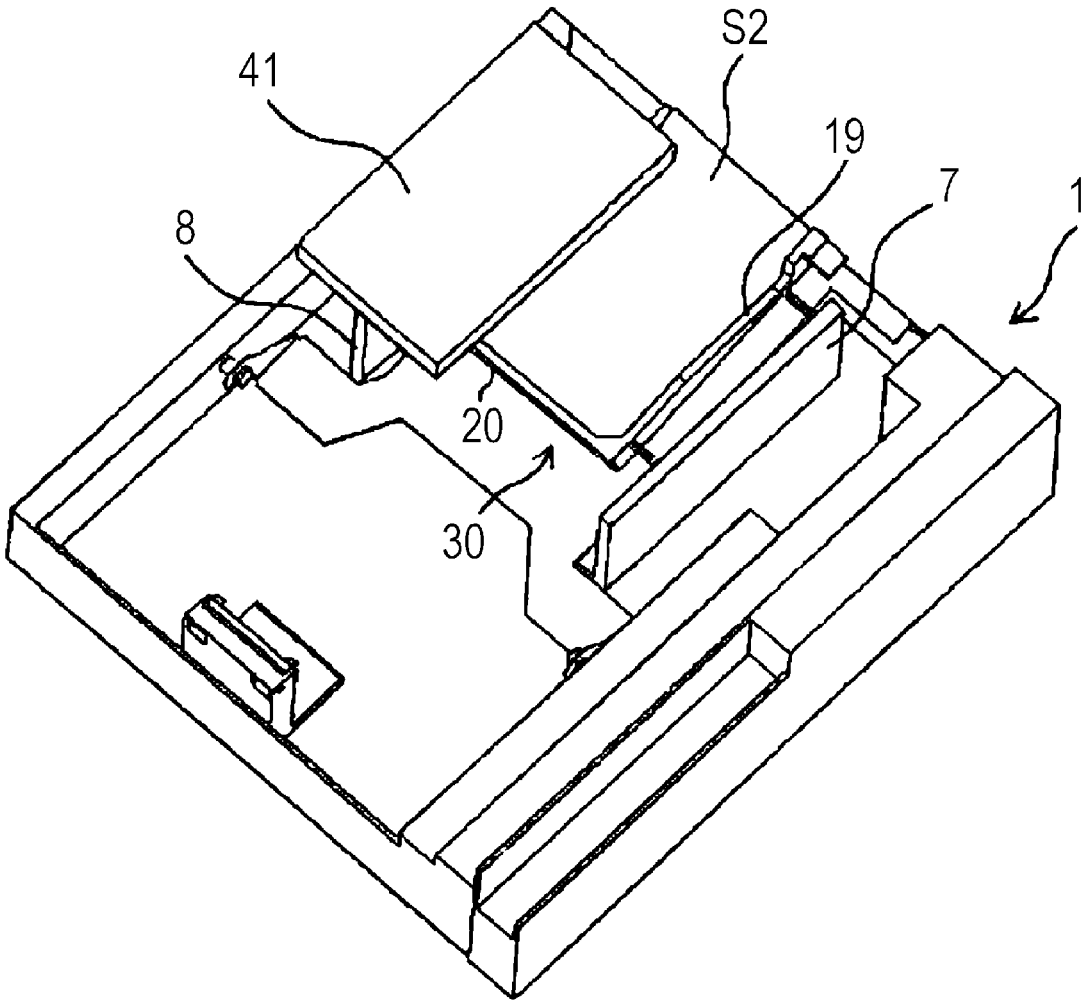
FIG. 10 illustrates a state in which an interference member exists above a movable member provided in the dedicated cassette.

As illustrated in FIG. 10, sometimes an interference member 41 exists above the dedicated cassette 30. When the interference member 41 exists, the number of small-size sheets S2 is decreased to lift the intermediate plate 6, the movable member 13 is lifted along with the dedicated cassette 30 as the intermediate plate 6 is lifted, and the movable member 13 is brought in abutting contact with the interference member 41 from below.

Figure 11:
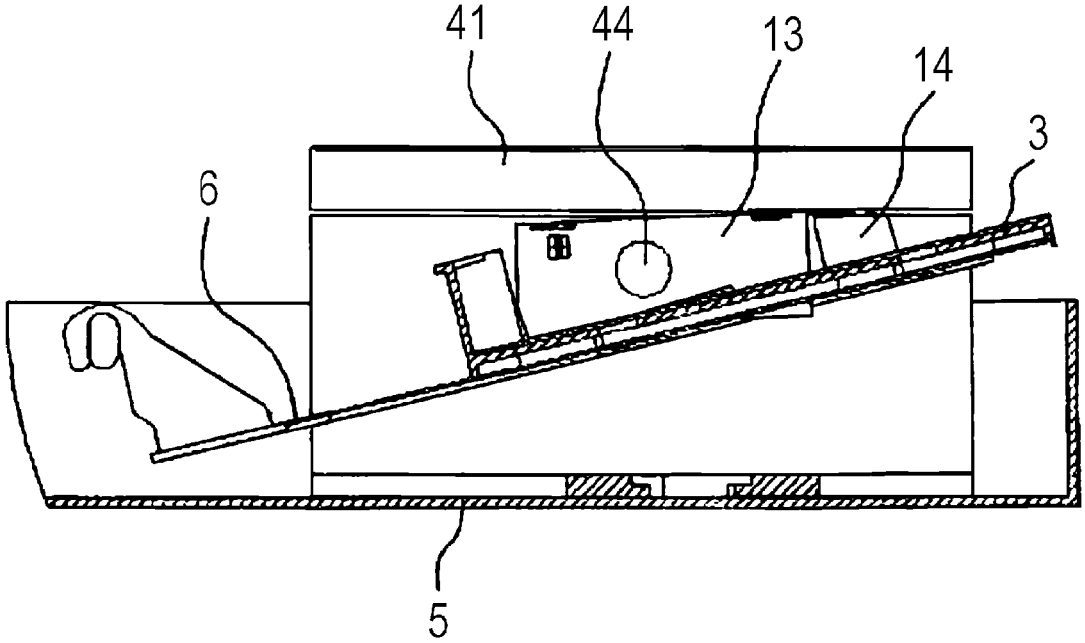
FIG. 11 illustrates a state in which the movable member is swung in abutting contact with the interference member.

At this point, as described above, the movable member 13 can be swung about the shaft 44 of FIG. 7 in the direction in which the intermediate plate 6 is lifted and lowered. Therefore, the movable member 13 is brought in abutting contact with the interference member 41 and, as illustrated in FIG. 11, the movable member 13 is swung downward about the shaft 44 against the biasing force of the spring 12 of FIG. 7. Because the number of small-size sheets S2 becomes small when the intermediate plate 6 is lifted, the regulation in the width direction of the small-size sheet S2 is maintained even if the movable member 13 is swung.

The intermediate plate 6 is lifted when the sheet is run out in the sheet cassette 1. When the sheet cassette 1 is drawn in the width direction to refill the sheet while the intermediate plate 6 is lifted, sometimes the dedicated cassette 30 attached to the intermediate plate 6 in the lifted state collides with another component of the printer main body 50A. In such cases, when the dedicated cassette 30 collides with another component, desirably a slope 42 in which the sheet cassette 1 can be drawn while the intermediate plate 6 is gently pushed down is placed in the fixed member 19 or the sheet stacking portion 14.

In order to improve usability, sometimes a positioning mechanism is provided in the sheet cassette 1 in order to position the side regulating members 7 and 8, when the side regulating members 7 and 8 are moved to the positions that regulate the standard-size sheet. In regulating the standard-size sheet, when the positions of the side regulating members 7 and 8 are close to the position at which the dedicated cassette 30 is used, sometimes the side regulating members 7 and 8 are moved according to the positioning of the dedicated cassette 30.

Possibly, the small-size-sheet regulating effect is reduced, when the side regulating members 7 and 8 are moved according to the positioning of the dedicated cassette 30 although the small-size sheet S2 is regulated. Therefore, when the positions of the side regulating members 7 and 8 are close to the position at which the dedicated cassette 30 is used, desirably the positions of the side regulating members 7 and 8 when sandwiching the dedicated cassette 30 are set so as to avoid the positioning point performed by the positioning mechanism.

As described above, the positions of the movable member 13 and fixed member 19 of the dedicated cassette 30 are regulated by the side regulating members 7 and 8, so that the sheet can stably be fed with the simple configuration without decreasing the strength of the intermediate plate 6.

In the embodiment described above, the intermediate plate 6 can be moved in the width direction with respect to the sheet cassette 1 or the dedicated cassette 30 can be moved with respect to the intermediate plate 6 such that the sheet stored in the dedicated cassette 30 is fed based on the center of the dedicated cassette 30. However, the invention is not limited to the embodiment.

Figure 12:
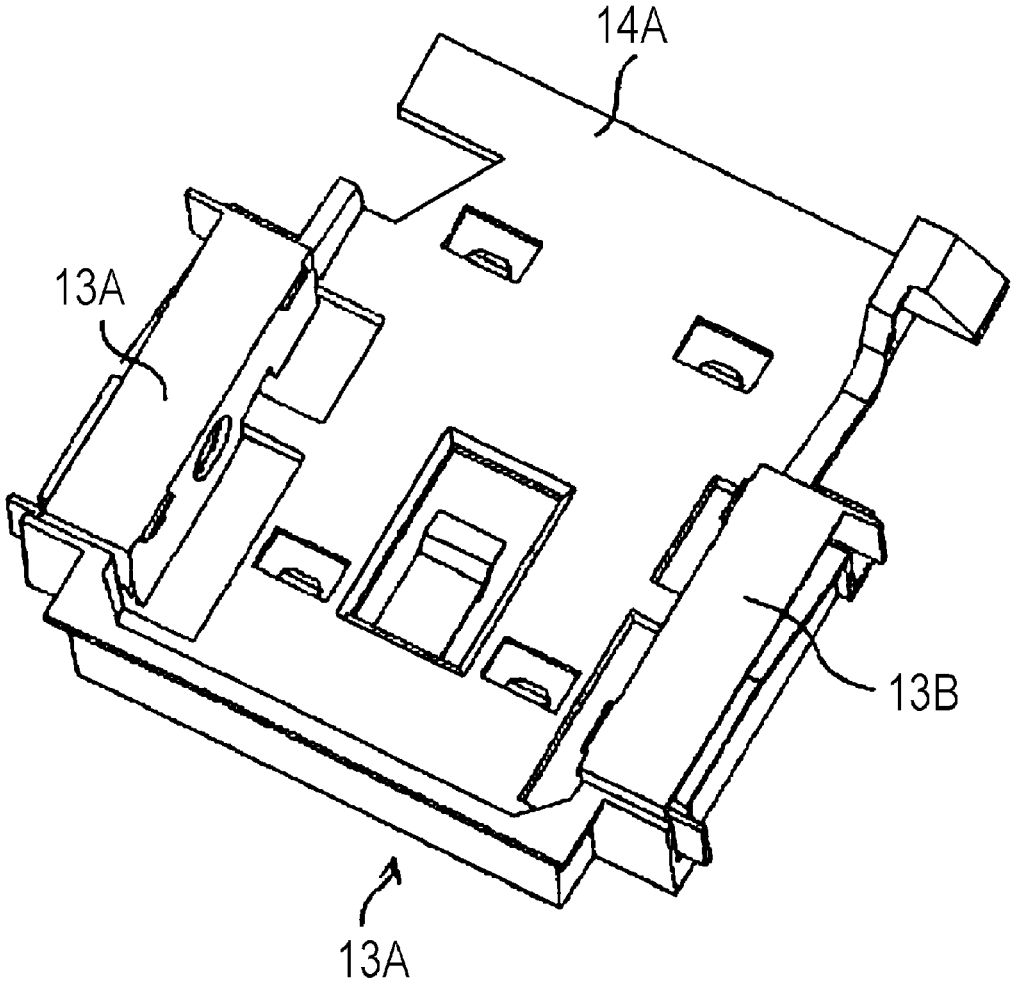
FIG. 12 is a perspective view illustrating a different configuration of the dedicated cassette.
Figure 13:
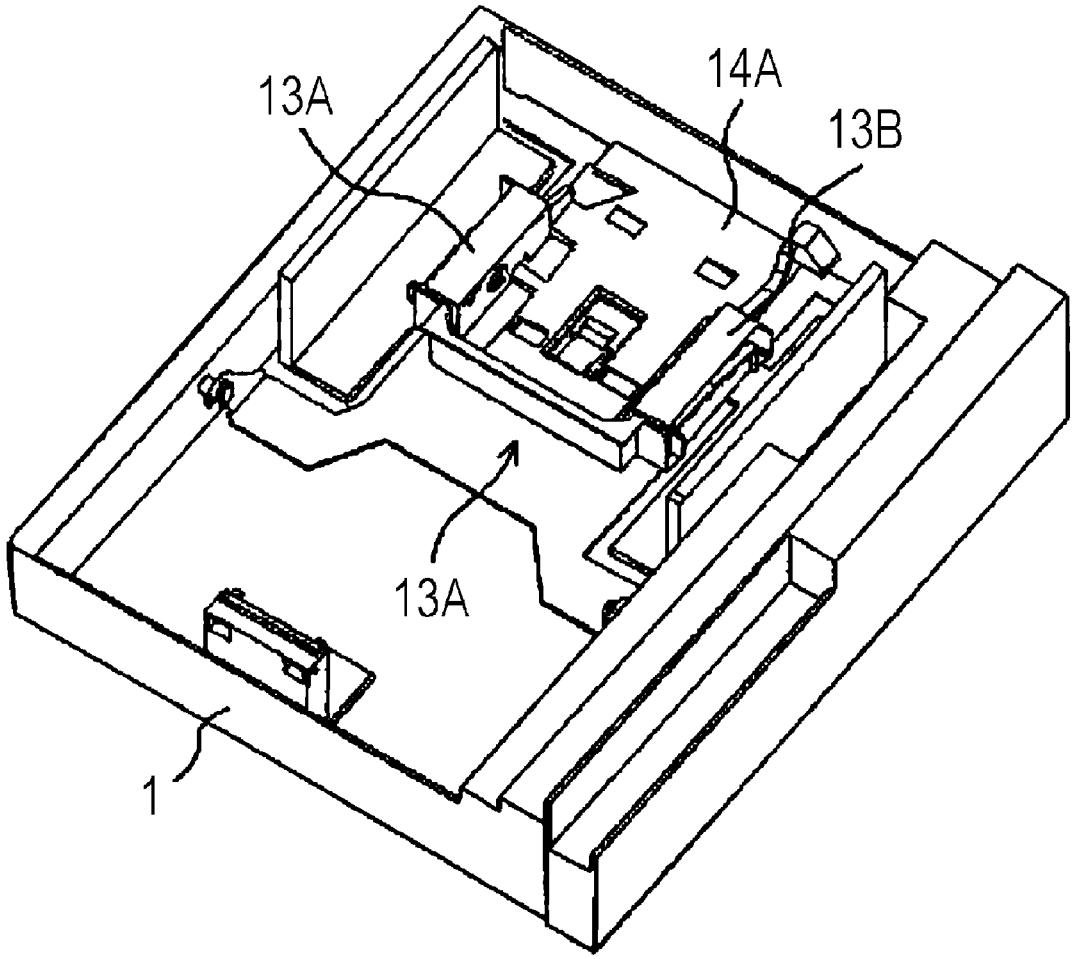
FIG. 13 is a perspective view illustrating a state in which the dedicated cassette having the different configuration is attached to the sheet cassette.

For example, sometimes the range where the intermediate plate 6 can be moved is restricted with respect to the sheet cassette 1, or sometimes the range where the dedicated cassette 30 can be moved is restricted with respect to the intermediate plate 6. In such cases, as illustrated in FIGS. 12 and 13, a dedicated cassette 30A may include a sheet stacking portion 14A and two movable members 13A and 13B that can be moved in the width direction along the sheet stacking portion 14A. Therefore, with such configuration, even if the dedicated cassette 30A is not moved in the width direction, the small-size sheet stored in the dedicated cassette 30A can be fed based on one side of the sheet cassette 1 or the center of the sheet cassette 1.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2008-198732, filed Jul. 31, 2008, which is hereby incorporated by reference herein in its entirety.

What is claimed is:

1. A sheet feeding apparatus comprising:

a sheet stacking portion, provided to be lifted and lowered, on which a sheet is stacked;

a pair of first regulating portions that is provided while being movable in a width direction of the sheet in order to regulate a position in the width direction of the sheet stacked on the sheet stacking portion;

a sheet stacking unit that is attached to the sheet stacking portion;

a pair of second regulating portions that regulates the position in the width direction of the sheet stacked on the sheet stacking unit; and a biasing member that biases at least one of the pair of second regulating portions, wherein the pair of second regulating portions are regulated by the pair of first regulating portions, respectively, and wherein at least one of the pair of second regulating portions is movable in the width direction, and at least one of the pair of second regulating portions can be swung in a direction in which the sheet stacking portion is lifted and lowered, at least one of the pair of second regulating portions is lifted along with the sheet stacking unit when the sheet stacking portion is lifted, and at least one of the pair of second regulating portions is swung downward against a biasing force of the biasing member while being brought in abutting contact with a member located above when at least one of the pair of second regulating portions is brought in abutting contact with the member located above.

2. The sheet feeding apparatus according to claim 1, wherein positioning portions abutting on the pair of first regulating portions are respectively provided in the pair of second regulating portions while the sheet stacking unit is attached to the sheet stacking portion, and the positioning portions provided in the pair of second regulating portions are equal to each other in a distance from a sheet regulating surface of the second regulating portion to an abutting surface abutting on a sheet regulating surface of the first regulating portion in the positioning portion.

3. The sheet feeding apparatus according to claim 1, wherein a small-size sheet whose position in the width direction cannot be regulated by the first regulating portion is stacked on the sheet stacking unit.

4. An image forming apparatus comprising:

an image forming portion that forms an image in a sheet; and a sheet feeding apparatus that feeds the sheet to the image forming portion, wherein the sheet feeding apparatus includes:

a sheet stacking portion, provided to be lifted and lowered, on which the sheet is stacked;

a pair of first regulating portions that is provided while being movable in a width direction of the sheet in order to regulate a position in the width direction of the sheet stacked on the sheet stacking portion;

a sheet stacking unit that is attached to the sheet stacking portion;

a pair of second regulating portions that regulates the position in the width direction of the sheet stacked on the sheet stacking unit; and a biasing member that biases at least one of the pair of second regulating portions, at least one of the pair of second regulating portion being able to be swung, wherein the pair of second regulating portions are regulated by the pair of first regulating portions, respectively, and wherein at least one of the pair of second regulating portions is movable in the width direction, at least one of the pair of second regulating portions can be swung in a direction in which the sheet stacking portion is lifted and lowered, at least one of the pair of second regulating portions is lifted along with the sheet stacking unit when the sheet stacking portion is lifted, and at least one of the pair of second regulating portions is swung downward against a biasing force of the biasing member while being brought in abutting contact with a member located above when at least one of the pair of second regulating portion is brought in abutting contact with the member located above.

5. The image forming apparatus according to claim 4, wherein positioning portions abutting on the pair of first regulating portions are respectively provided in the pair of second regulating portions, respectively and the positioning portions provided in the pair of second regulating portions are equal to each other in a distance from a sheet regulating surface of the second regulating portion to an abutting surface abutting on a sheet regulating surface of the first regulating portion in the positioning portion.

6. The image forming apparatus according to claim 4, wherein a small-size sheet whose position in the width direction cannot be regulated by the first regulating portion is stacked on the sheet stacking unit.

* * * * *